US007677486B2

(12) United States Patent
Hoppé et al.

(10) Patent No.: US 7,677,486 B2
(45) Date of Patent: Mar. 16, 2010

(54) ASSEMBLY OF AN ELECTRODYNAMIC FRACTIONATING UNIT

(75) Inventors: Peter Hoppé, Stutensee (DE); Harald Giese, Stutensee (DE)

(73) Assignee: Forschungszentrum Karlsruhe GmbH, Karlsruhe (DE)

( * ) Notice: Subject to any disclaimer, the term of this patent is extended or adjusted under 35 U.S.C. 154(b) by 635 days.

(21) Appl. No.: 10/574,644

(22) PCT Filed: Aug. 17, 2004

(86) PCT No.: PCT/EP2004/009193

§ 371 (c)(1),
(2), (4) Date: Apr. 19, 2007

(87) PCT Pub. No.: WO2005/032722

PCT Pub. Date: Apr. 14, 2005

(65) Prior Publication Data

US 2007/0187539 A1 Aug. 16, 2007

(30) Foreign Application Priority Data

Oct. 4, 2003 (DE) ..... 103 46 055

(51) Int. Cl.
*B02C 19/00* (2006.01)
*B02C 13/286* (2006.01)

(52) U.S. Cl. ..... 241/301; 241/1

(58) Field of Classification Search ..... 241/1, 241/301

See application file for complete search history.

(56) References Cited

U.S. PATENT DOCUMENTS 3,604,641 A 9/1971 Donoghue et al.
5,758,831 A 6/1998 Collins et al.
6,164,388 A 12/2000 Martunovich et al.
7,246,761 B2 * 7/2007 Hoppe et al. ..... 241/1
2005/0051644 A1 * 3/2005 Paris et al. ..... 241/1

FOREIGN PATENT DOCUMENTS

DE 19736027 A1 3/1999
DE 19902010 A1 8/2000
RU 1 164 942 A 2/1995
WO WO-96/26010 A1 8/1996

OTHER PUBLICATIONS

Database WPI Section PQ, Week 199536 Derwent Publications Ltd., London, GB; Class P41, AN 1995-274037 XP002304649.

* cited by examiner

*Primary Examiner*—Faye Francis
(74) *Attorney, Agent, or Firm*—Venable LLP; Robert Kinberg; Christopher Ma

(57) ABSTRACT

The assembly of an electrodynamic fractionating unit, for the fragmentation, milling or suspension of a brittle, mineral process material is disclosed. The energy store including the output switch/spark gap thereof, the electrodes including the supply line and the reaction vessel are each arranged at least within the protection of the electrically necessary insulating separation of regions of differing electrical potential, completely enclosed in a volume of the encapsulation, having electrically-conducting walls. The wall thickness of the encapsulation is at least equivalent to the penetration depth, corresponding to the lowest components of the Fourier spectrum of the pulsed electromagnetic field. The electrode at reference potential is connected to the ground side of the energy store through the encapsulation wall. The electrode at high voltage is connected by the shortest path to the output switch on the energy store.

9 Claims, 4 Drawing Sheets

ASSEMBLY OF AN ELECTRODYNAMIC FRACTIONATING UNIT

BACKGROUND

1. Field of the Invention

The invention relates to the assembly of an electrodynamic fractionating unit (FRANKA=Fraktionieranlage Karlsruhe), used for fragmenting, grinding, or suspending a brittle mineral material to be processed.

2. Related Art

All presently known units of this type, developed for the processing of mineral materials by means of fragmenting, material removal, drilling or similar processing methods, in particular the electrodynamic method, with the aid of high-power, high-voltage discharges, comprise the following main components:

The energy store, meaning the unit for generating a high-voltage (HV) pulse, which frequently or in most cases is a Marx generator known from the field of high-voltage pulse technology, and the application-specific reaction/process vessel filled with a process fluid. The exposed end region of a high-voltage electrode which is connected to the energy store is completely submerged into this fluid. The electrode at reference potential is arranged opposite the high-voltage electrode and, in most cases, is a correspondingly designed bottom of the reaction vessel which functions as earth electrode. If the amplitude of the high-voltage pulse at the high-voltage electrode reaches a sufficiently high value, an electric arc-over occurs from the high-voltage electrode to the earth electrode. Depending on the prevailing geometric conditions and the form, particularly the rise time for the high-voltage pulse, the arc-over travels through the fragmentation material positioned between the electrodes and is thus highly effective. An arc-over which travels only through the process fluid at best can only generate shock waves, which are not very effective.

For the duration of the high-voltage pulse, the electrical circuit is formed by the energy store C with thereto connected high-voltage electrode, the space between the high-voltage electrode and the bottom of the reaction vessel, and the return-flow line from the vessel bottom to the energy store. This circuit comprises the capacitive, ohmic, and inductive components C, R and L, which influence the form of the high-voltage pulse (see FIG. 6), meaning the speed at which it rises as well as the further chronological course of the discharge current and thus also the pulse power introduced into the load and, as a result, the efficiency of the discharge with respect to the material fragmentation. For the discharge current pulse interval, the electrical energy amount $Ri^2$ is converted to heat in the ohmic resistance R of this temporary circuit. This energy amount consequently is no longer available for the actual fractionating operation.

This circuit represents a conductor loop through which extremely high currents of approximately 2-5 kA flow during an extremely short interval. A configuration of this type generates intensive electromagnetic radiation, meaning it represents a radio transmitter with high radiation capacity, which must be screened with the aid of expensive technology to avoid causing interference in the technical environment. In general, a unit of this type must be screened with the aid of protective devices in such a way that no contact with live, current-carrying components is possible during the operation. In turn, this quickly leads to extensive protective installations over and above the actual assembly for use.

All units known so far, which operate based on the electrodynamic method, have an open design, meaning the components of such a unit are connected to each other by electrical lines (see FIG. 6).

For the fragmenting of rock-type material, for example as described in reference WO 96/26 010, connecting lines between the electric energy store and the spark gap are visible, which form current-carrying loops during the discharge of the HV pulse. Material removal systems (DE 197 36 027 C2), systems for drilling in solid rock (U.S. Pat. No. 6,164,388), or inerting systems (DE 199 02 010 C2) respectively show simple electrical lines that are connected to the high-voltage electrode.

SUMMARY

It is the object of the present invention to configure the circuit layout for a FRANKA unit during the high-voltage pulse discharge in such a way that the inductivity as well as the ohmic resistance of the discharge circuit are restricted to a minimum while, at the same time, the technical expenditure for the required protective screening against electromagnetic radiation and for preventing any contact is also kept at a minimum.

This object is solved with an assembly of the fractionating unit as detailed in the characterizing features below.

The energy store together with its output switch, wherein the latter is normally a spark gap primarily operated or triggered by self disruptive discharge, the electrodes together with the feed line, and the reaction vessel are positioned in a volume that is completely enclosed by an electrically conductive wall, meaning the encapsulation, while maintaining the required insulation distance to areas with different electrical potential. The volume between the encapsulation and therein disposed components is kept at a minimum and the inductivity of the unit is consequently restricted to the unavoidable minimum. Applying the laws of electro-physics in this manner makes it possible to achieve the shortest rise time for the discharge pulse, typical for a unit of this type.

On the one hand, the wall thickness is at least equal to the penetration depth of the lowest component of the Fourier spectrum for the pulsed electromagnetic field, meaning it is primarily determined by it. On the other hand, the mechanical strength also requires a minimum wall thickness. The necessary greater wall thickness, resulting from one or the other of the two requirements, is taken into consideration for the construction.

With this type of complete encapsulation, the electrode at reference potential is connected via the encapsulation wall to the ground potential side of the energy store. The remaining current flow is central to the encapsulation, via the energy store and the components which are temporarily connected to the high-voltage potential.

This type of encapsulated assembly is advantageous from an electro-physical and operational technical point of view, wherein its features are further specified below.

According to an embodiment, the wall of the encapsulation has a removable section for the batch-feeding or to gain access for a continuous feed-in, depending on the mode of operation. In any case, in the exemplary embodiment sections of the encapsulation must be removable for repair work.

In an embodiment, at least one outward-pointing pipe section of a conductive material is provided in the encapsulation wall for the batch-type feeding to ensure a continuous processing of the fragmentation product, as well as at least one additional pipe section for the material removal. Owing to the electrical screening toward the outside, the length and clear width of these pipe sections are dimensioned such that at least the high-power, high-frequency shares in the spectrum of the electromagnetic field, generated by the high-voltage pulse, do not escape through these pipe sections, or at the very least are weakened to the legally prescribed level while still inside the pipe sections, meaning prior to reaching the pipe opening to the environment.

The energy store and the reaction vessel are spatially separated inside the encapsulation. According to an embodiment, the energy store is located in one inside front wall region of the encapsulation and the reaction vessel is located in its other front wall region or is formed by this region.

In an embodiment, the encapsulation is a closed, tubular body with a polygonal or round cross section, wherein the encapsulation can either be elongated or can be angled at least once. The structural design is determined by the installation plans, with the elongated form representing the simplest form.

According to an embodiment, the electrode at reference potential is consequently positioned in the center of the front wall of the reaction vessel while the high-voltage electrode is positioned at a distance thereto in the center of the opposite wall (claim 6). The high-voltage electrode is connected directly to the output switch of the energy store, wherein this output switch is the output spark gap when a Marx generator is used for the energy store. As a result, the electrically most advantageous and the insulation-technically most useful coaxial design is obtained for any type of encapsulation, thus making it possible to satisfy the requirements of encapsulation and the lowest inductivity, typical for these units.

In an embodiment, there are no restrictions concerning the set-up of the unit. The electrical energy store together with the output switch is positioned inside the encapsulation, either spatially above, or at the same level, or spatially below, relative to the reaction vessel.

According to an embodiment, the electrode at reference potential in most cases is the earth electrode, the center portion of the front, or the screening bottom, or the ring-shaped or rod-shaped electrode, depending on the type of fragmentation.

In an embodiment, The energy store is separated from the reaction vessel by a protective wall, so that the reaction chamber is separated fluid-tight from the region of the energy store.

The high-voltage pulse traveling between the high-voltage electrode and the bottom of the reaction vessel, and/or the current traveling from one electrode to the other one, converts the introduced electrical energy to varying amounts of different types of energy, among other things also mechanical energy, and finally to mechanical waves/shock waves. The encased portion of the high-voltage electrode is encased with electrically insulating material until just before the end region, wherein this end region is completely submerged in the process fluid.

The assembled unit, which is completely screened toward the outside and comprises an energy store and/or pulse generator and process reactor in a joint, electrically conductive housing, has several advantages as compared to the standard, open design:

The inductivity of the discharge circuit is and/or can be reduced to the absolutely required minimum;

The ohmic losses in the high-voltage pulse circuit are also limited to the unavoidable minimum level;

The minimum inductivity and the minimum ohmic resistance of the pulse circuit result in a more efficient discharge into the load, meaning to a higher amount of energy being introduced into the load. The so-to-speak closed design of the unit has critical advantages with respect to the electromagnetic radiation and the protection against contact. The discharge current flows exclusively on the inside of the unit during the complete duration of the HV pulse interval. In any case, this is self-evident since the current flows from the energy store comprising the pulse generator, via the high-voltage electrode and the load, the reaction fluid with fragmentation product, to the bottom of the reaction vessel because of the screening function of the electrically conductive encapsulation.

The current flowing from the bottom of the reaction vessel back to the energy store flows along the inside wall of the hollow-cylindrical encapsulation since it is a characteristic of the magnetic field generated by the discharge current that flows briefly through the unit to minimize the area enclosed by the conductor loop. This return-flow current, which briefly flows along the inside of the unit wall, penetrates the wall material only to a shallow depth because of the skin effect, meaning the frequency-dependent penetration depth. As is known, the penetration depth depends on the electrical conductivity of the wall material and the frequency spectrum that appears in the discharge current. Given the standard rise times for the high-voltage pulse of approximately 500 ns, a characteristic self-oscillation interval for the discharge circuit of approximately 0.5 μs, and the use of simple steel materials such as structural steel for the unit wall, the penetration depth on the inside wall is less than 1 mm. The wall thickness of the encapsulation must of necessity take into consideration the lowest frequency of the Fourier spectrum for the electrical discharge because of the penetration depth (skin effect), as well as the required mechanical strength for maintaining the form of the unit. The determining factor is the higher minimum requirement for the wall thickness stemming from one of the two requirements. Since no electrical voltages can thus build up on the outer surface of the encapsulation, there is no need for a protective screen against contact and the expenditure for the assembly is kept to a minimum. In addition, no electromagnetic radiation can escape to the outside.

The unit with coaxial assembly is compact, easy to handle, and accessible from a measuring and control technical point of view. The electrical charging device for the energy store does not have to be screened separately. Its feed line can extend with the aid of bushings and without problem to the energy store, located in the top inside area of the housing, possibly by means of a coaxial cable with an outside conductor that makes contact with the housing.

BRIEF DESCRIPTION OF THE DRAWINGS

The completely encapsulated metal fragmentation unit is explained in further detail in the following with the aid of the drawing, which shows in:

FIG. 5 A diagram of the FRANKA unit with the reaction vessel installed at the top, while

DETAILED DESCRIPTION

Figure 1:
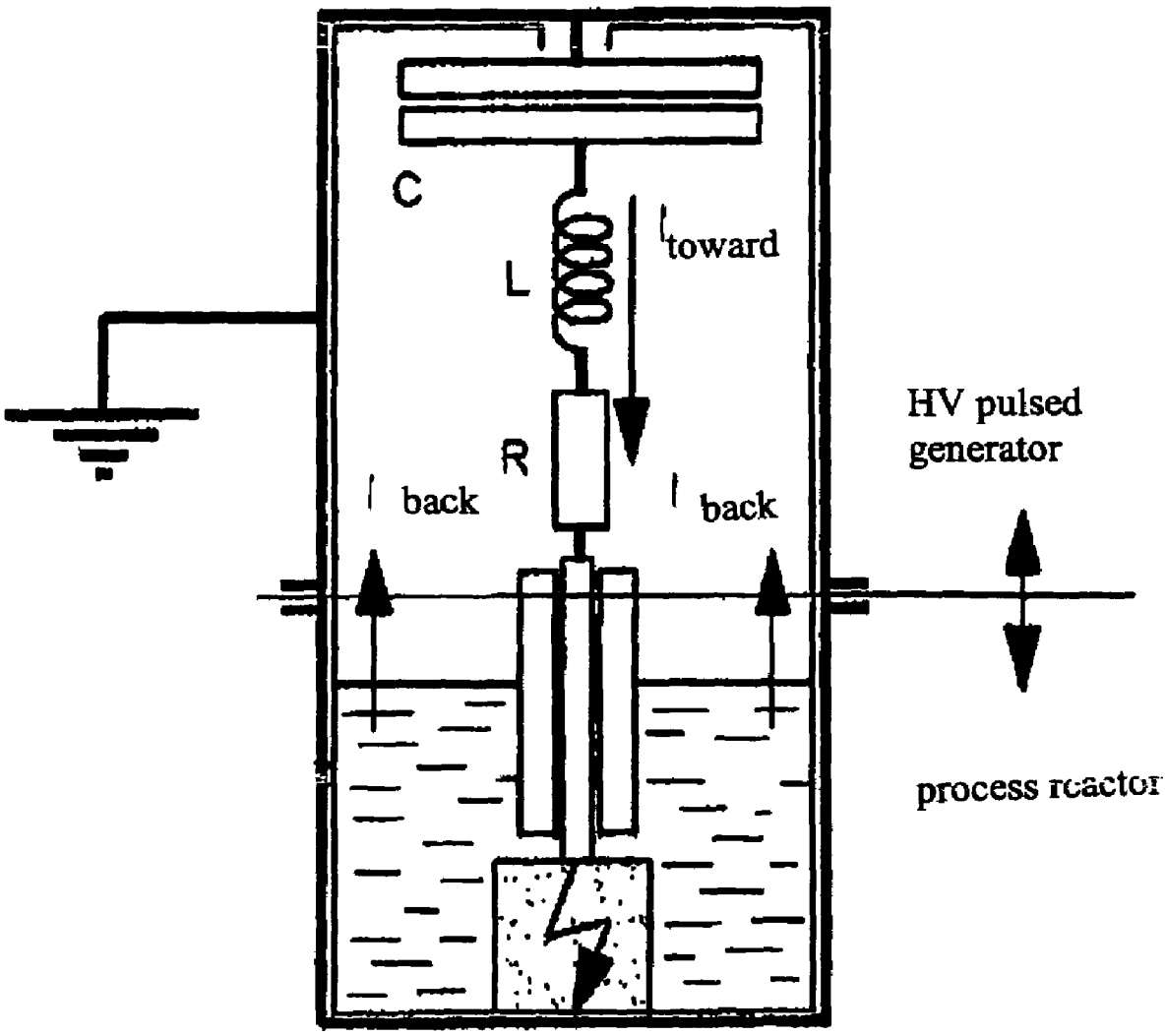
FIG. 1 The FRANKA unit with coaxial assembly.

FIG. 1 schematically shows a sectional view in axial direction through the coaxially assembled FRANKA unit. The continuous or discontinuous mode of operation is not taken into consideration herein because the emphasis is on the electrical layout. Also not indicated is the electrical charging device for charging the electrical energy store 3. From an electrical point of view, the coaxial assembly is extremely advantageous and a change from this assembly would be made only for compelling structural reasons.

The high-voltage pulse generator consists of the schematically shown electrical store C in the form of a capacitor, the inductivity L, and the ohmic resistance R, which are connected in series. The high-voltage electrode 5 follows. This electrode is electrically insulated against the environment by a dielectric casing, starting with the electrical connection to the resistance R and extending into the end region. Its exposed end region 4 is submerged in a process/reaction volume, indicated with a lightning symbol, where it assumes a predetermined, adjustable distance to the bottom of the process/reaction vessel 3 which forms the lower portion of the coaxial, hollow-cylindrical housing 6.

During the high-voltage discharge, the current flow in the structural components is along the axis of the hollow-cylindrical housing 6, for the most part in at least one discharge channel in the process volume, toward the bottom of the reaction vessel 3 and from there via the housing wall 6 back to the energy store/capacitor 1. The housing 6 is connected to the reference potential "earth."

The inductivity L and the resistance R are representative of the unit inductivity and the unit resistance; C indicates the electrical capacity and thus via the charging voltage the available storage energy of ½ C $(nU)^2$ which is for the most part converted in the process volume. If a Marx generator is used as HV pulse generator, the at least two-stage configuration (n=2) of the generator, the single capacity C, and the step charging voltage U, as well as the number of steps n, are critical variables for the storage energy.

Figure 6:
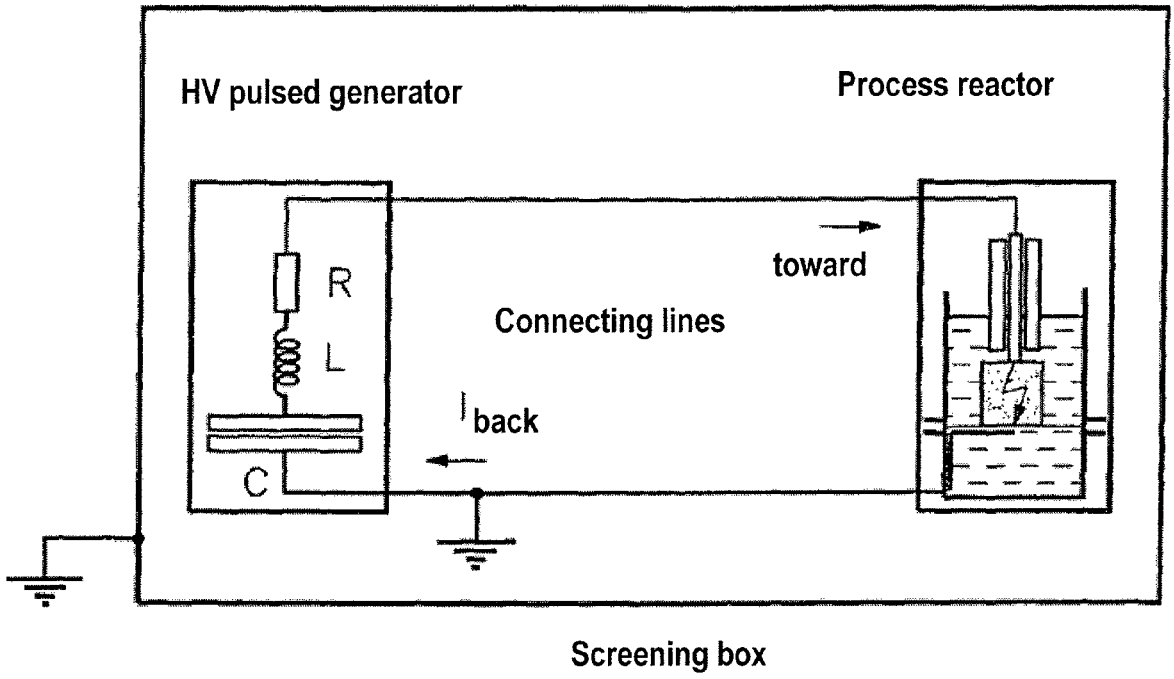
FIG. 6 (PRIOR ART)
FIG. 6 shows the standard FRANKA unit.

FIG. 6 schematically shows the configuration of a standard FRANKA unit, which can be and is assembled easily for many laboratory operations.

Figure 2:
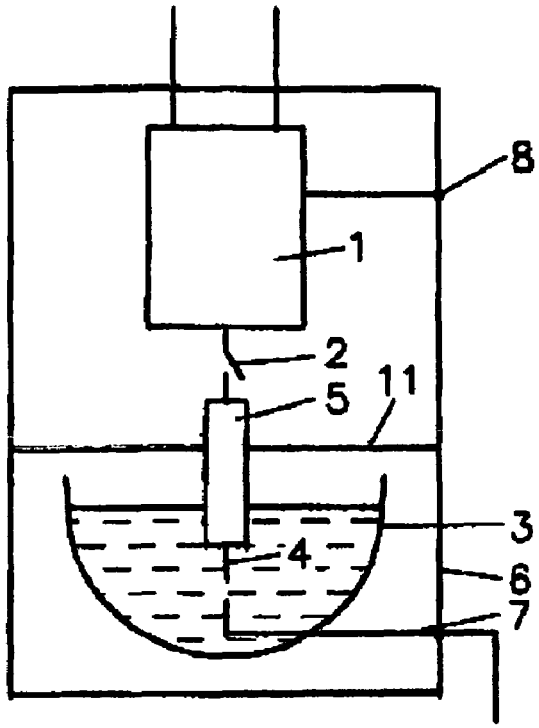
FIG. 2 A diagram of the FRANKA unit with a separating wall.

FIGS. 2 to 5 show diagrammatic views of coaxial variants of a FRANKA unit, wherein:

FIG. 2 shows the separation of the energy store 1 from the reactor region 3 by means of a separating wall in the region of the high-voltage electrode 5. This feature should be incorporated in particular if the discharge operation results in creating a spray of fluid.

Figure 3:
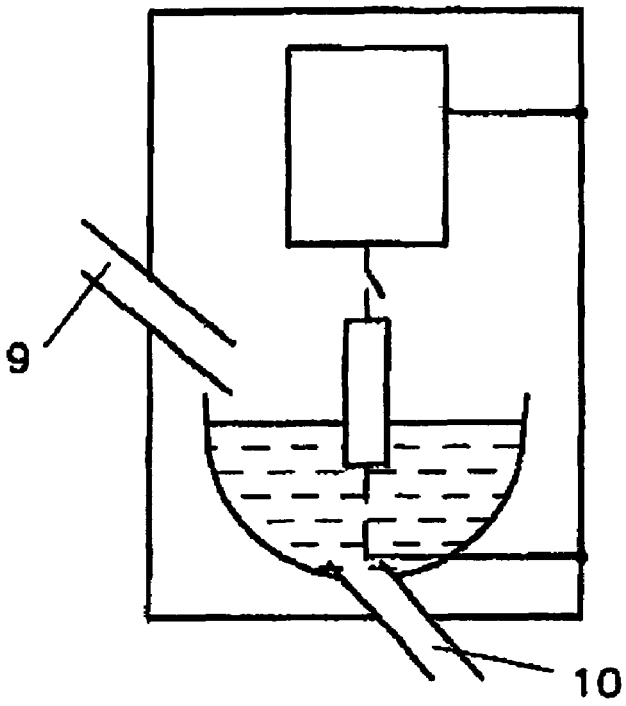
FIG. 3 A diagram of the FRANKA unit for the continuous operation.

FIG. 3 shows two openings in the encapsulation 6, the first one in the casing area where material is filled into the reaction vessel 3 and the second one where material leaves the reaction vessel 3, for example through the bottom. This structural measure ensures a continuous operation with loading and unloading.

Figure 4:
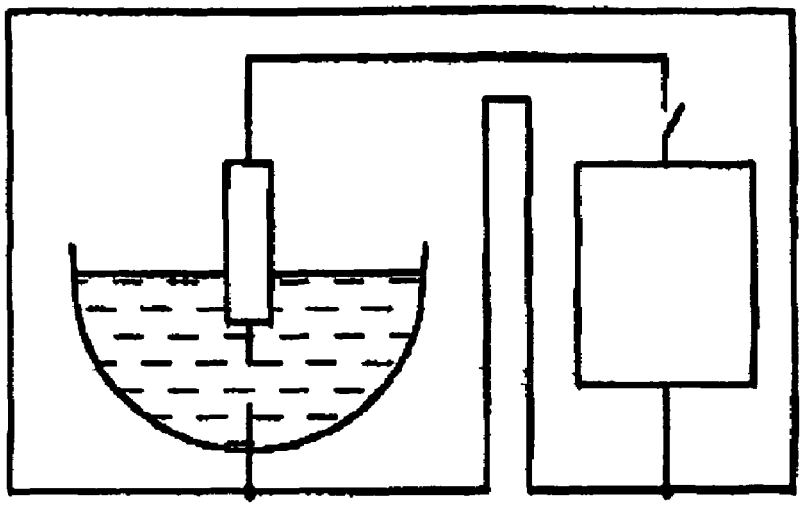
FIG. 4 A diagram of the FRANKA unit with U-shaped encapsulation.

FIG. 4 shows the U-shaped encapsulation 3, wherein this structural design is the preferred design for a large system because of weight and manageability.

Figure 5:
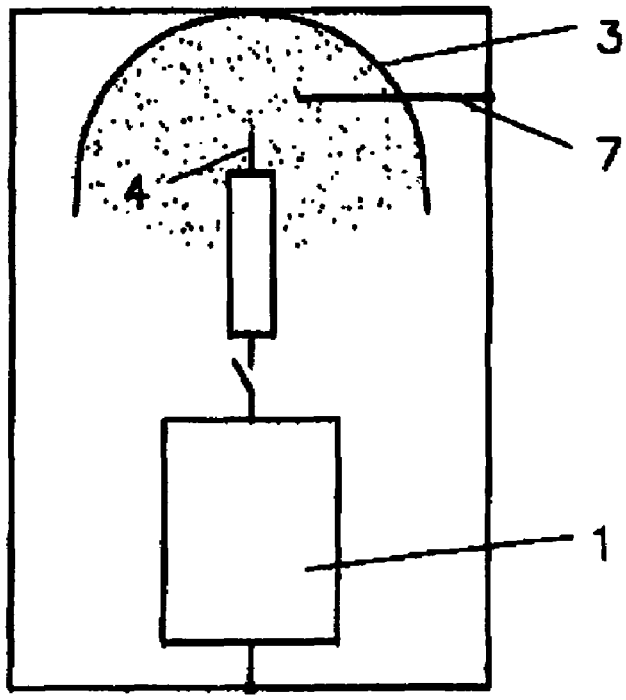

FIG. 5 contains a sketch of an upside down design, wherein the reaction vessel 3 is positioned above the energy store 1. A structural design of this type could offer itself for the processing of gaseous or extremely lightweight materials which are stirred up.

FIG. 6 shows the assembly of a standard FRANKA unit which, as fully functioning unit, is additionally encapsulated by a wall to protect against contact. The large electrical loop is not minimized and functions as a strong transmitting antenna in the case of a pulse. For that reason, it is strictly controlled by legal regulations when used for industrial applications.

REFERENCE NUMBER LIST

1. energy store
2. output switch/spark gap
3. reaction vessel
4. front of the high-voltage electrode
5. high-voltage electrode with insulator
6. encapsulation
7. connection between process vessel—encapsulation
8. connection between charging device—encapsulation
9. fill-in pipe section
10. discharge pipe section

The invention claimed is:

1. Assembly of an electrodynamic fractionating unit for the fragmenting, grinding, or suspending of a brittle material to be processed, said unit comprising:

a chargeable electrical energy store with two electrodes connected to its output, wherein one of these electrodes is at reference potential while the other electrode can be admitted with a pulsed high voltage via an output switch on the energy store;

a reaction vessel filled with a process fluid in which the material to be processed is submerged and the two exposed electrode ends are arranged at an adjustable distance opposite each other, thereby forming the reaction zone, wherein the electrode which can be admitted with high voltage is surrounded by an insulating casing right up to the exposed end region and wherein this insulating casing in the end region is also submerged in the process fluid;

characterized in that, the energy store together with its output switch, the electrodes with feed line, and the reaction vessel are positioned in a completely enclosed volume surrounded by an electrically conductive wall, meaning the encapsulation, and that this volume enclosed by the encapsulation is at a minimum, the wall thickness of the encapsulation at least equals the penetration depth corresponding to the lowest component of the Fourier spectrum of the pulsed electromagnetic field and has at least the thickness required for the mechanical strength, that the electrode at reference potential is connected via the encapsulation wall to the ground potential side of the energy store, and that the electrode admitted with high voltage is connected via the shortest distance to the output switch on the energy store.

2. The assembly as defined in claim 1, characterized in that sections of the encapsulation wall can be removed or that the encapsulation wall is provided with at least one area of access for the batch-type processing of the fragmentation product.

3. The assembly as defined in claim 2, characterized in that the encapsulation wall is a hollow body with the energy store installed in one inside front wall region while the other front wall region forms the reaction vessel.

4. The assembly as defined in claim 3, characterized in that the encapsulation has a polygonal or round cross section and an elongated form or a form that is angled at least once.

5. The assembly as defined in claim 4, characterized in that the electrode at reference potential is installed in the center of the front wall of the reaction vessel, that the high-voltage electrode is positioned in the center of the opposite wall, and that the latter is connected to the output switch of the energy store via a path that is coaxial to the encapsulation.

6. The assembly as defined in claim 5, characterized in that the electrical energy store together with the output switch is positioned in the encapsulated area either above or on the same level or spatially below, relative to the reaction vessel.

7. The assembly as defined in claim 6, characterized in that the electrode at reference potential is embodied to form a central part of the front, or is embodied as perforated bottom, or as ring-shaped or rod-shaped electrode.

8. The assembly as defined in claim 1, characterized in that for the continuous processing of the fragmentation product, the encapsulation wall is provided with at least one pipe section of a conductive material, which is directed toward the outside and is used for the batch feeding, as well as at least one additional pipe section for the material removal, wherein the length and clear width of these pipe sections are dimensioned such that at least the high-power, high-frequency share of the spectrum of the electromagnetic field, generated by the high voltage pulse, cannot escape through these pipe sections or is weakened to the legally prescribed level inside the pipe sections before reaching the opening to the environment.

9. The assembly according to claim 1, characterized in that the energy store is separated from the reaction vessel by a protective wall.

* * * * *